US005910088A

United States Patent [19]

Staples et al.

[11] Patent Number: 5,910,088

[45] Date of Patent: Jun. 8, 1999

[54] AIR INFILTRATION PREVENTION IN BUILDINGS

[75] Inventors: Lawrence L. Staples, Bridgeton; Timothy O'Neil, Olivette, both of Mo.

[73] Assignee: Aladdin Insulation & Roofing, Inc., Berkeley, Mich.

[21] Appl. No.: 09/090,361

[22] Filed: Jun. 4, 1998

Related U.S. Application Data

[60] Provisional application No. 60/048,548, Jun. 4, 1997.

[51] Int. Cl.[6] ..... F04B 1/66

[52] U.S. Cl. ..... 52/741.4; 52/745.21

[58] Field of Search ..... 52/741.4, 745.21

[56] References Cited

U.S. PATENT DOCUMENTS

| | | | |
|---|---|---|---|
| 3,707,062 | 12/1972 | Joiner, Jr. | 52/745.21 |
| 3,995,401 | 12/1976 | Smith | 52/745.21 X |
| 5,339,798 | 8/1994 | Christian | 52/265 X |
| 5,687,520 | 11/1997 | Stranahan et al. | 52/741.4 X |
| 5,713,164 | 2/1998 | Ryan | 52/741.4 X |

*Primary Examiner*—Christopher Kent

*Attorney, Agent, or Firm*—Senninger, Powers Leavit & Roedel

[57] ABSTRACT

A method for reducing air infiltration in a building having a frame constructed with wooden components. Glue is applied to abutting wooden surfaces to provide a seal between such surfaces to prevent air flow between such surfaces.

9 Claims, 1 Drawing Sheet

AIR INFILTRATION PREVENTION IN BUILDINGS

This application claims priority of provisional application 60/048,548 filed Jun. 4, 1997.

BACKGROUND OF THE INVENTION

This invention is directed to a method for reducing infiltration of air into a residence or other building, which reduction in air infiltration results in a reduction in heating and cooling requirements.

In insulating a building it has been the prior practice to reduce the infiltration of air into and within the building by applying caulk to fill some gaps between boards, voids and other locations where air would otherwise have an opportunity to seep into the building and from one location in the building to another location. For example, between two components of a double stud supporting a window header, there is typically a small gap in places where the two surfaces do not lay completely flat against each other. It has been the practice to apply a strip of caulk along such seams in order to fill in any gaps where air would tend to have an opportunity to flow. A disadvantage of this approach has been that this filling in of gaps provides is incomplete and, particularly over time as the abutting pieces move relative to each other, further gaps are formed which allow air to nonetheless flow between the abutting components. Caulk does not expand and contract sufficiently to keep such gaps sealed through seasonal cycles.

SUMMARY OF THE INVENTION

An object of the present invention is to provide an improved method for reducing air infiltration in a building.

Briefly, therefore, the invention is directed to a method for reducing air infiltration in a building having a frame comprising wooden components, the method comprising applying glue to abutting wooden surfaces to provide a seal between such surfaces to prevent air flow between such surfaces.

Other objects and features of the invention will be in part apparent and in part pointed out hereinafter.

DETAILED DESCRIPTION OF THE INVENTION

One aspect of this invention involves installation into a building, during construction, of an energy packaging in which various abutting surfaces in the building are glued to each other. This is in contrast to applying a substance such as caulk essentially only fills in gaps between abutting surfaces, but does not bind and seal the gaps like glue does. By gluing such surfaces together, an actual seal is created between the surfaces which more completely blocks the flow of air between such surfaces. Furthermore, by gluing such surfaces together, longer lasting air infiltration is imparted to such surfaces which withstands minor movement of such surfaces relative to each other, and normal expanding and contracting through the seasons and through the years.

Figure 1:
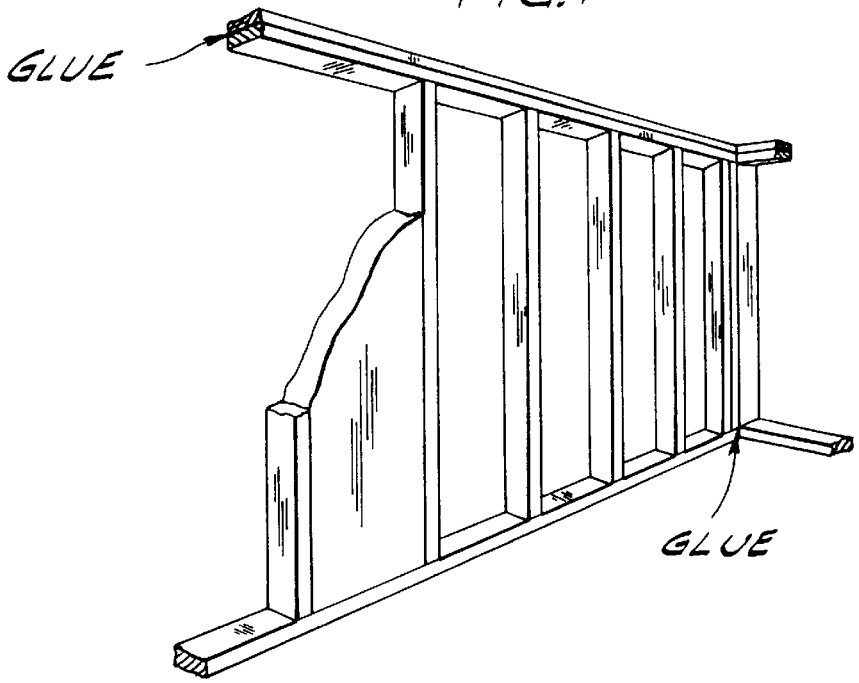
FIG. 1 is a perspective view of a wall panel system treated in accordance with the method of the invention.
Figure 2:
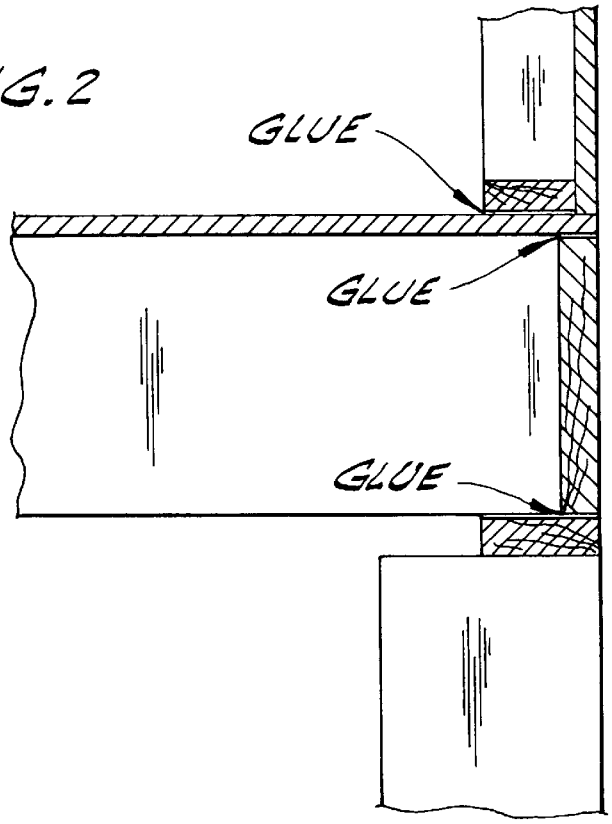
FIG. 2 is a schematic view of a joint treated in accordance with the method of the invention.

The invention involves applying glue to bind wooden components known as double plates together in a building as shown in FIG. 1, to block air infiltration between the two plates. The glue is applied once the frame and exterior sheeting of the building is in place, but prior to installation of fiber insulation. Glue is applied between double studs which support, for example, window and door headers to bind the two studs together and prevent air infiltration between them. Glue is applied where surfaces of wooden components abut at corners of wall frames at, for example, a 90° angle as shown in FIG. 1 and other corners. Glue is applied at abutting surfaces at subfloors and where subfloors meet exterior wall plates. Glue is applied where floor joists abut other surfaces, as shown in FIG. 2. Glue is applied where bandboards surfaces abut other surfaces. Glue is applied at most surfaces where two-by-fours and other wooden components abut each other and other surfaces. Optionally, glue is applied to joints in air ducts. The effect of the foregoing is to form a permanent seal between all of the aforementioned surfaces which seal blocks the flow of air between such surfaces. It is preferred that a seal is created at the majority of the above-described abutting surfaces, more preferred that a seal is created at 85% of the above-described abutting surfaces, most preferably that a seal is created at all of the above-described abutting surfaces within the building. This reference to, for example, "majority of," "85% of," and "all of the above-described surfaces" is intended to convey that where, for example, two 2-by-4s lay on top of each other, glue is applied to "all" of the abutting length. This is not intended to convey that "all" of the abutting surface area is sealed. To seal the entirety of the abutting surfaces of two 2-by-4s, it is necessary to apply glue to the entire length of contact, but not to the entire flat contacting surfaces of the respective boards. The same concept applies to the reference to "majority" and "85%" in this sentence. What is critical is to create a seal at the majority of, 85% of, or all of, the abutting surfaces, to seal the majority of, 85% of, or all of the gaps between such surfaces, which does not require application of glue to the entirety of such surfaces.

In carrying out the gluing of surfaces together, the glue preferably is a hydrocarbon-based adhesive containing petroleum distillates, more preferably an aromatic hydrocarbon-based adhesive, still more preferably a benzene derivative based adhesive, most preferably a naphthalene- and benzene-based adhesive. One preferred glue is commercially available from Glidden Company under the trade name "Liquid Nails." This glue contains petroleum distillates, polymers with petroleum naphtha, benzene, 1,3,-diethenyl-, polymer with 1,3-butadiene and ethenylbenzene, carbonic acid, calcium salt, kaolin, solvent naphtha, light aliphatic, quartz, 3-methylpentane, 2,2-dimethylbutane, 2,3-dimethylbutane, and 2-methylpentane. The preferred glue has elastomeric properties which allow it to expand and contract as the wooden components expand and contract.

Because this glue, as contrasted with caulk, has the ability to expand and contract as abutting surfaces expand and contract, the integrity of the seal between abutting surfaces is not compromised as the building undergoes normal expansion and contraction due to changes in temperature. Sealing a house by this method has been determined to reduce air infiltration by about half.

In another embodiment of the invention, the foregoing sealing operation is carried out in combination with application of insulating material around windows and doors, behind electric boxes at exterior walls, and at wire and pipe holes at exterior walls and interior attic walls. The preferred material for this optional operation is that which is commercially available from Owens Corning under the trade designation "Pink Seal."

In accordance with this invention it is preferred to reduce air infiltration to less than about 0.7 air changes per hour, preferably to less than about 0.5 air changes per hour.

A second optional aspect of this invention involves testing for air infiltration after a first phase of sealing and further sealing with glue where air infiltration is determined not to have been prevented. During construction of a home, this energy package is installed and the home is tested for air infiltration prior to installation of fiberglass insulation. Testing involves temporary installation of a blower door into an exterior doorway in the home. This blower door essentially pulls a vacuum on the house to detect and quantify leaks. One then examines the house throughout with a smoke stick while the blower is in operation in order to detect any significant leaks, representing air infiltration, and then seals such leaks using glue. In many instances this operation is not performed because there is sufficient confidence in the first sealing operation.

A third aspect of this invention involves a link among an insulation installer, a lending institution, and new home purchaser, which link is essentially a method of increasing the potential size of the purchaser's home. Lending institutions are prepared to lend a greater amount of money to the purchaser of a home having the above-noted air infiltration package because the purchaser's utility bills will be reduced by, for example, 20% over the life of the home. The purchaser is therefore able to purchase a larger home.

EXAMPLE

Three homes under construction were sealed in accordance with the method of the invention after all of the trusses, floors, and exterior wall panels were in place. In particular, glue available under the trade designation "Liquid Nails" was applied between the following abutting surfaces: double plates, double studs, studs and headers, corner surfaces of wall frames, subfloors and exterior wall plates, bandboard surfaces and subfloors, bandboards and plates, and two-by-fours. A high density ceiling insulation package was installed in each of the three homes. A fourth home under construction was prepared with a standard R-38 ceiling insulation package without application of glue between abutting surfaces to serve as a control home for comparison.

A blower door was installed in a door to each of the four homes. Upon operation of the blower door, the control home was determined to undergo 0.95 air changes per hour. The three homes prepared in accordance with the invention underwent 0.52, 0.24, and 0.62 air changes per hour, for an average of 0.46 air changes per hour. By comparison of 0.95 air changes to 0.46 air changes, it is evident that air infiltration was reduced by more than 50%.

As various changes could be made in the above embodiments without departing from the scope of the invention, it is intended that all matter contained in the above description shall be interpreted as illustrative and not in a limiting sense.

What is claimed is:

1. A method for reducing air infiltration in a building, the method comprising applying glue to a majority of abutting wooden surfaces in a building having a frame constructed from wooden frame components comprising said wooden surfaces to seal gaps between said wooden surfaces to block air flow between such surfaces, said applying of said glue being carried out after said frame, including trusses, floors, and exterior wall panels of the building are secured in place, and said glue having elastomeric properties allowing it to expand and contract as wooden surfaces to which it is applied expand and contract.

2. The method of claim 1 wherein said wooden frame components comprise plates, double plates, double studs, studs, headers, wall frames, subfloors, exterior wall plates, bandboards, subfloors, and two-by-fours.

3. The method of claim 2 wherein the glue is a hydrocarbon-based adhesive containing petroleum distillates.

4. The method of claim 2 including applying glue to create a seal between abutting surfaces at the following abutting surfaces: double plates, double studs, studs and headers, corner surfaces of wall frames, subfloors and exterior wall plates, bandboard surfaces and subfloors, bandboards and plates, and two-by-fours.

5. The method of claim 4 wherein glue is applied to at least about 85% of said abutting surfaces in the building.

6. The method of claim 1 comprising:

applying glue to create a seal between abutting surfaces of wooden components forming double plates of wall panels;

applying glue to create a seal between abutting surfaces of wooden components of double studs supporting window and door headers;

applying glue to create a seal between abutting surfaces of wooden wall panels forming corners; and applying glue to create a seal between abutting surfaces at subfloors and where subfloors meet exterior wall plates.

7. The method of claim 1 comprising, in sequence:

a) applying glue to create a seal between wooden components forming double plates, between wooden components of double studs supporting window and door headers, between abutting surfaces of wooden wall panels forming corners, between abutting surfaces at subfloors and where subfloors meet exterior wall plates;

b) drawing air into the building and locating gaps between abutting surfaces; and c) applying glue to seal gaps located in step (b).

8. A method for reducing air infiltration to less than about 0.7 air changes per hour in a residence having a frame comprising wooden components, the method comprising applying glue to abutting wooden surfaces to provide a seal between such surfaces to block air flow between such surfaces and reduce air infiltration to less than about 0.7 air changes per hour.

9. The method of claim 8 comprising applying glue to abutting wooden surfaces to provide a seal between such surfaces to block air flow between such surfaces and reduce air infiltration to less than about 0.5 air changes per hour.

* * * * *

US005910088C1

(12) EX PARTE REEXAMINATION CERTIFICATE (7038th)

United States Patent
Staples et al.

(10) Number: US 5,910,088 C1
(45) Certificate Issued: Sep. 1, 2009

(54) AIR INFILTRATION PREVENTION IN BUILDINGS

(75) Inventors: Lawrence L. Staples, 12747 Wynfield Pines Dr., St. Louis, MO (US) 63131; Timothy O'Neil, Olivette, MO (US)

(73) Assignee: Lawrence L. Staples, St. Louis, MO (US)

Reexamination Request:
No. 90/010,156, May 2, 2008

Reexamination Certificate for:

| | |
|---|---|
| Patent No.: | **5,910,088** |
| Issued: | **Jun. 8, 1999** |
| Appl. No.: | **09/090,361** |
| Filed: | **Jun. 4, 1998** |

Related U.S. Application Data

(60) Provisional application No. 60/048,548, filed on Jun. 4, 1997.

(51) Int. Cl.
*E04B 1/00* (2006.01)

(52) U.S. Cl. ..... 52/741.4; 52/745.21

(58) Field of Classification Search ..... 52/741.4, 52/745.21

See application file for complete search history.

(56) References Cited

U.S. PATENT DOCUMENTS

| | | | | | |
|---|---|---|---|---|---|
| 1,971,994 | A | * | 8/1934 | Smith | 52/316 |
| 3,969,859 | A | * | 7/1976 | Hisey | 52/233 |
| 4,510,724 | A | * | 4/1985 | Magnuson | 52/233 |
| 5,384,994 | A | * | 1/1995 | Borba | 52/261 |
| 5,398,471 | A | * | 3/1995 | Spagnolo | 52/412 |
| 5,525,147 | A | * | 6/1996 | Dunstan et al. | 106/18.3 |
| 5,687,520 | A | * | 11/1997 | Stranahan et al. | 52/233 |

OTHER PUBLICATIONS

Perma–Chink Systems, Inc. "Log Home Sealant Application Guide", pp. 1–9.*

Maloney, Jim, "*Air–Leakage Control Manual,*" Residential Construction Demonstration Project, May 1991, 45 pages.

"*Bibliographic Citation,*" Energy Citations Database of U.S. Department of Energy Office of Scientific and Technical Information, Apr. 24, 2008, 1 page.

Horton, Mark, "*Material Safety Data Sheet,*" Jul. 17, 1995, 4 pages, ChemRex, Inc., Shakopee, MN, United States.

* cited by examiner

*Primary Examiner*—Aaron J. Lewis

(57) ABSTRACT

A method for reducing air infiltration in a building having a frame constructed with wooden components. Glue is applied to abutting wooden surfaces to provide a seal between such surfaces to prevent air flow between such surfaces.

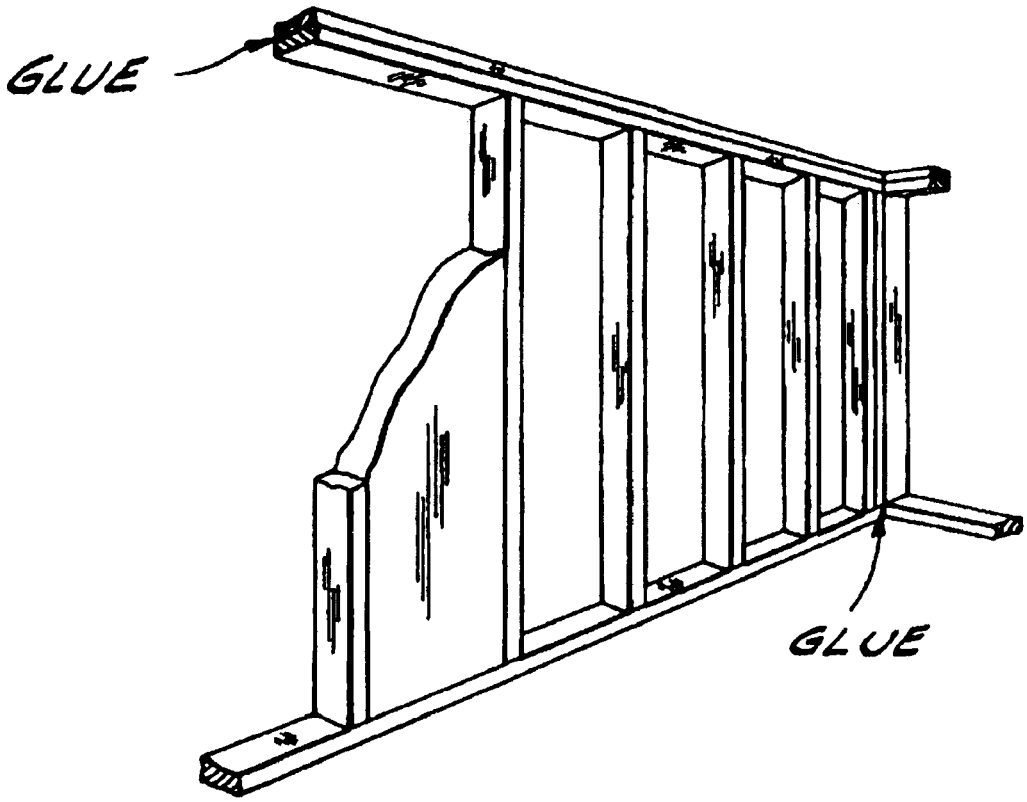

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

Claims 1, 8 and 9 are cancelled.

Claims 2, 6 and 7 are determined to be patentable as amended.

Claims 3, 4 and 5, dependent on an amended claim, are determined to be patentable.

New claims 10–16 are added and determined to be patentable.

2. [The method of claim 1] *A method for reducing air infiltration in a building, the method comprising applying glue to a majority of abutting wooden surfaces in a building having a frame constructed from wooden frame components comprising said wooden surfaces to seal gaps between said wooden surfaces to block air flow between such surfaces, said applying of said glue being carried out after said frame, including trusses, floors, and exterior wall panels of the building are secured in place, and said glue having elastomeric properties allowing it to expand and contract as wooden surfaces to which it is applied expand and contract, and* wherein said wooden frame components comprise plates, double plates, double studs, studs, headers, wall frames, subfloors, exterior wall plates, bandboards, subfloors, and two-by-fours.

6. [The method of claim 1 comprising:] *A method for reducing air infiltration in a building, the method comprising applying glue to a majority of abutting wooden surfaces in a building having a frame constructed from wooden frame components comprising said wooden surfaces to seal gaps between said wooden surfaces to block air flow between such surfaces, said applying of said glue being carried out after said frame, including trusses, floors, and exterior wall panels of the building are secured in place, and said glue having elastomeric properties allowing it to expand and contract as wooden surfaces to which it is applied expand and contract, wherein said applying glue comprises*:

applying glue to create a seal between abutting surfaces of wooden components forming double plates of wall panels;

applying glue to create a seal between abutting surfaces of wooden components of double studs supporting window and door headers;

applying glue to create a seal between abutting surfaces of wooden wall panels forming corners; and applying glue to create a seal between abutting surfaces at subfloors and where subfloors meet exterior wall plates.

7. [The method of claim 1 comprising,] *A method for reducing air infiltration in a building, the method comprising applying glue to a majority of abutting wooden surfaces in a building having a frame constructed from wooden frame components comprising said wooden surfaces to seal gaps between said wooden surfaces to block air flow between such surfaces, said applying of said glue being carried out after said frame, including trusses, floors, and exterior wall panels of the building are secured in place, and said glue having elastomeric properties allowing it to expand and contract as wooden surfaces to which it is applied expand and contract, wherein said applying glue comprises* in sequence:

a) applying glue to create a seal between wooden components forming double plates, between wooden components of double studs supporting window and door headers, between abutting surfaces of wooden wall panels forming corners, between abutting surfaces at subfloors and where subfloors meet exterior wall plates;

b) drawing air into the building and locating gaps between abutting surfaces; and c) applying glue to seal gaps located in step (b).

*10. A method for reducing air infiltration in a building, the method comprising applying glue to a majority of abutting wooden surfaces in a building having a frame constructed from wooden frame components comprising said wooden surfaces to seal gaps between said wooden surfaces to block air flow between such surfaces, said applying of said glue being carried out after said frame, including trusses, floors, and exterior wall panels of the building are secured in place, and said glue having elastomeric properties allowing it to expand and contract as wooden surfaces to which it is applied expand and contract, and wherein said wooden frame components comprising said wooden surfaces comprise two-by-fours and studs.*

*11. A method for reducing air infiltration to less than about 0.7 air changes per hour in a residence having a frame comprising wooden components, the method comprising applying glue to abutting wooden surfaces to provide a seal between such surfaces to block air flow between such surfaces and reduce air infiltration to less than about 0.7 air changes per hour, wherein the glue has elastomeric properties allowing it to expand and contract as wooden surfaces to which it is applied expand and contract.*

*12. A method for reducing air infiltration to less than about 0.5 air changes per hour in a residence having a frame comprising wooden components, the method comprising applying glue to abutting wooden surfaces to provide a seal between such surfaces to block air flow between such surfaces and reduce air infiltration to less than about 0.5 air changes per hour, wherein the glue has elastomeric properties allowing it to expand and contract as wooden surfaces to which it is applied expand and contract.*

*13. The method of claim 11 wherein the glue is applied to a majority of the abutting wooden surfaces in the residence.*

*14. The method of claim 12 wherein the glue is applied to a majority of the abutting wooden surfaces in the residence.*

*15. The method of claim 12 wherein said applying glue to abutting wooden surfaces comprises applying glue to abutting boards.*

*16. The method of claim 11 wherein said applying glue to abutting wooden surfaces comprises applying glue to abutting boards.*

* * * * *

US005910088C2

(12) EX PARTE REEXAMINATION CERTIFICATE (7882nd)

United States Patent
Staples et al.

(10) Number: US 5,910,088 C2
(45) Certificate Issued: Nov. 16, 2010

(54) AIR INFILTRATION PREVENTION IN BUILDINGS

(75) Inventors: Lawrence L. Staples, 12747 Wynfield Pines Dr., St. Louis, MO (US) 63131; Timothy O'Neil, Olivette, MO (US)

(73) Assignee: Lawrence L. Staples, St. Louis, MO (US)

Reexamination Request:
No. 90/010,583, Jun. 24, 2009
No. 90/009,596, Sep. 24, 2009

Reexamination Certificate for:

| | |
|---|---|
| Patent No.: | **5,910,088** |
| Issued: | **Jun. 8, 1999** |
| Appl. No.: | **09/090,361** |
| Filed: | **Jun. 4, 1998** |

Reexamination Certificate C1 5,910,088 issued Sep. 1, 2009

Related U.S. Application Data

(60) Provisional application No. 60/048,548, filed on Jun. 4, 1997.

(51) Int. Cl.
*E04B 1/00* (2006.01)

(52) U.S. Cl. ..... 52/741.4; 52/745.21

(58) Field of Classification Search ..... None
See application file for complete search history.

(56) References Cited

U.S. PATENT DOCUMENTS 5,384,994 A * 1/1995 Borba ..... 52/261
5,910,088 A 6/1999 Staples et al.

OTHER PUBLICATIONS

Marbek Resource Consultants, "Air Sealing Homes for Energy Conservation," 461 pages, 1984, Energy, MInes and Resources, Canada.
Consumer's Guide, "Keeping the Heat In," 117 pages, 1994, Natural Resources Canada.
William A. Shurcliff, "Super Insulated Houses and Double Envelope Houses," 190 pages, 1981, Brick House Publishing C., Andover, MA.
Arne Elmroth and Per Levin, "Air Infiltration Control In Housing, A Guide to International Practice," 416 pages, 1983, Swedish Council for Building Research, Stockholm, Sweden.
Jim Maloney, "Air–Leakage Control Manual," 46 pages, 1991.
ECD Bibliographic Citation of Air–Leakage Control Manual, 2 pages, 1991, Bonneville Power Administration.
MSDS for PL200 Adhesive, 5 pages, 1995, ChemRex, Inc.
Joseph W. Lstiburek, Construction Experience Using the Airtight Drywall Approach, 193 pages, 1985, Alberta Municipal Affairs, Edmonton.
Canadian Home Builders' Association, Builders Manual, 356 pages, 1994, Canadian Home Builders' Association.
D. Eyre and D. Jennings, "Air–Vapour Barriers," 89 pages, Fourth Edition, 1983, Energy, Mines and Resources, Canada.
Johns–Manville Sales Corp., "Techniques for Control of Air Infiltration in Buildings," 127 pages, 1979.
ECD Bibliographic Citation of Techniques for Control of Air Infiltration in Buildings, 2 pages, 1979.

* cited by examiner

*Primary Examiner*—William C Doerrler

(57) ABSTRACT

A method for reducing air infiltration in a building having a frame constructed with wooden components. Glue is applied to abutting wooden surfaces to provide a seal between such surfaces to prevent air flow between such surfaces.

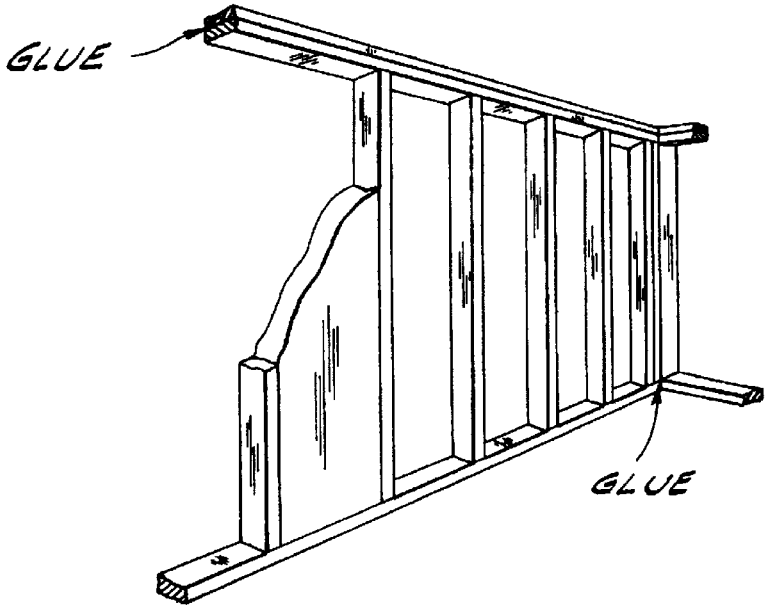

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 2-7, 10, 13 and 14 is confirmed.

Claims 1, 8 and 9 were previously cancelled.

Claims 11, 12, 15 and 16 are cancelled.

New claims 17-21 are added and determined to be patentable.

*17. The method of claim 6 wherein glue is applied to 85% of said abutting surfaces in the building.*

*18. The method of claim 7 wherein glue is applied to 85% of said abutting surfaces in the building.*

*19. The method of claim 10 wherein glue is applied to 85% of said abutting surfaces in the building.*

*20. The method of claim 11 wherein glue is applied to 85% of said abutting surfaces in the building.*

*21. The method of claim 12 wherein glue is applied to 85% of said abutting surfaces in the building.*

* * * * *